United States Patent [19]

Dolnick

[11] 3,935,890

[45] Feb. 3, 1976

[54] COVER FOR TOILET TANKS

[75] Inventor: Seymour S. Dolnick, Milwaukee, Wis.

[73] Assignee: Glen Mfg. Inc., Milwaukee, Wis.

[22] Filed: Apr. 28, 1975

[21] Appl. No.: 572,611

[52] U.S. Cl. ..... 150/52 R

[51] Int. Cl.[2] ..... A47K 13/00

[58] Field of Search ..... 150/52 R; 4/1, 252 A

[56] References Cited

UNITED STATES PATENTS

| | | | |
|---|---|---|---|
| 2,652,874 | 9/1953 | Armstrong | 150/52 R |
| 3,085,611 | 4/1963 | Dolnick | 150/52 R |
| 3,166,112 | 1/1965 | Fisher | 150/52 R |

*Primary Examiner*—Donald F. Norton

*Attorney, Agent, or Firm*—Wegner, Stellman, McCord, Wiles & Wood

[57] ABSTRACT

The invention relates to a cover for a toilet tank which is both decorative and which effectively prevents or eliminates condensation on the exterior walls of the tank, the toilet tank cover being characterized by being made of textile material laminated to a vapor barrier material, the latter carrying adhesive on both faces thereof, one face being adhesively secured to the back side of the textile cover and the other face being covered by a peel-off type protective material so that said other face may be applied directly to the front and side walls of a toilet flush tank.

1 Claim, 6 Drawing Figures

COVER FOR TOILET TANKS

BACKGROUND OF THE INVENTION

Where cold water is introduced into the tank of a toilet, the tank itself is cooled thereby and in periods of high humidity, such as summertime, water condenses on the exterior surfaces of the tank and may accumulate to the extent of dripping on the floor, which can be both unsightly and damaging.

A solution to the problem is shown in the patent to Armstrong, U.S. Pat. No. 2,652,874. That patent provided a textile cover for a toilet tank which, while not preventing condensation, acted to "blot up" the moisture condensing on the tank and thereby prevented dripping. During the night when the toilet was not used, the water in the tank would warm up and as a result, the moisture in the cover evaporated so that by the next morning it was dry, and ready to begin absorbing condensate.

A problem often encountered with the type of toilet tank cover shown in the Armstrong patent, was that of maintaining the cover in position on the toilet tank. As the cover absorbed moisture, it became heavier and often sagged in unsightly folds because of the weight, and sometimes because of the stretching of the textile material. Means such as sewing in elastic along the edges, etc., have been tried but were only partially successful in overcoming the problem.

SUMMARY OF THE INVENTION

The present invention provides a substantial improvement in covers for toilet flush tanks. The improvement is not only in the manner in which the cover is secured to the tank itself, but also by the very nature of the securing material the efficiency of the cover itself is improved. According to the present invention, the tank cover is made of a textile material, for example, chenille, which has a tufted face on one side and a relatively smooth face on the other. To the smooth back face of the textile there is laminated a vapor barrier comprising a sheet of plastic material carrying adhesive on both sides thereof. Thus, one side of the vapor barrier sheet is adhesively secured to the back or smooth side of the textile material, while the other side of the sheet which also carries an adhesive coating is covered by a peel-off type of protective film. When the cover is to be applied to a toilet tank, the protective film is peeled off by hand, exposing the adhesive face and the latter is applied directly to the toilet tank. The adhesion is complete over the entire area of the front and side walls of the tank from the bottom to above the water line therein, and the cover can easily be pressed into close conformity with the exterior walls of the tank even though they be decorative, i.e., be other than perfectly smooth in configuration.

DESCRIPTION OF THE PREFERRED EMBODIMENT

Figure 1:
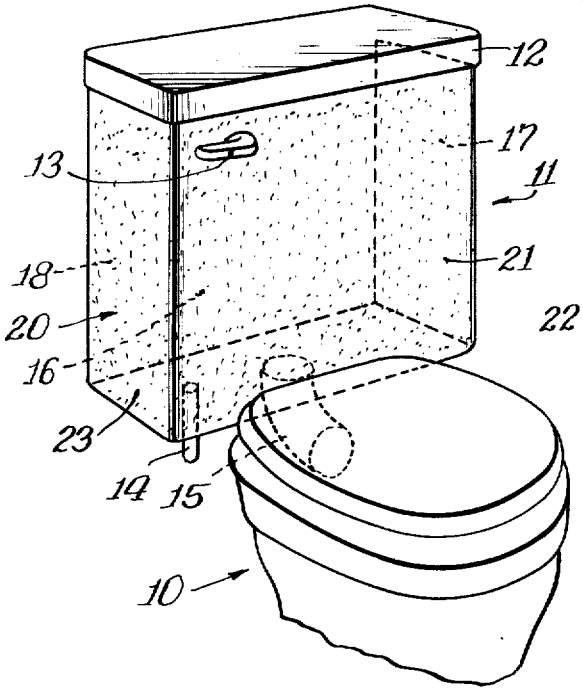
FIG. 1 is a perspective view of a toilet tank and toilet having a cover made according to the present invention.
Figure 2:
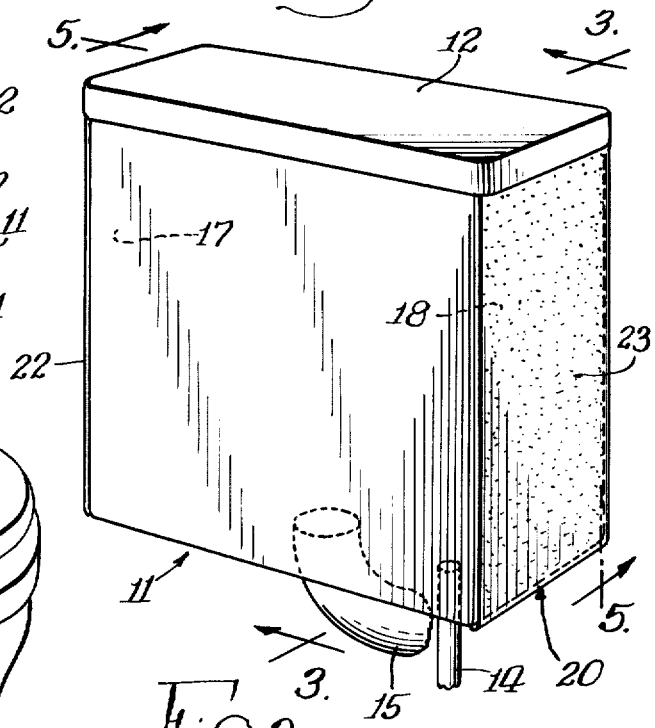
FIG. 2 is a rear view of the toilet tank of FIG. 1.

Referring now to the drawings, there is shown a toilet 10 provided with a usual toilet tank 11 having a lid 12 and a handle 13 for operating the toilet. An inlet pipe 14 is provided for introducing water into the tank and an outlet pipe 15 delivers water from the tank into the toilet 10.

The toilet tank has a front wall 16 and side walls 17 and 18, these walls being generally rectangular in shape in the particular toilet tank chosen for purposes of illustration.

Figure 4:
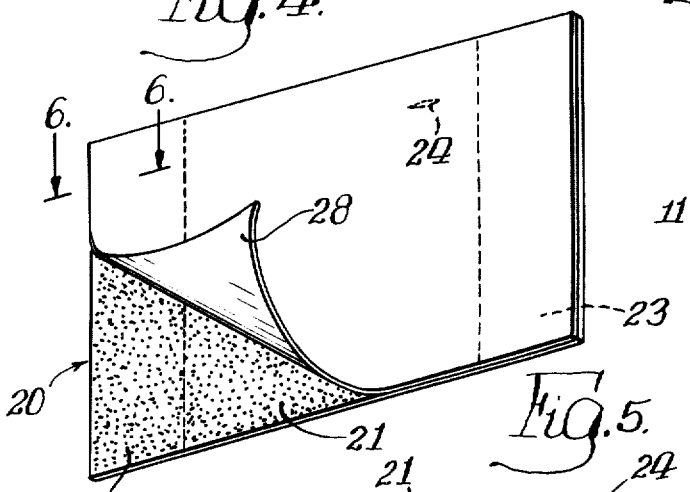
FIG. 4 is a perspective view of the back side of the toilet tank cover showing the peelable protective film or sheet partially removed.
Figure 3:
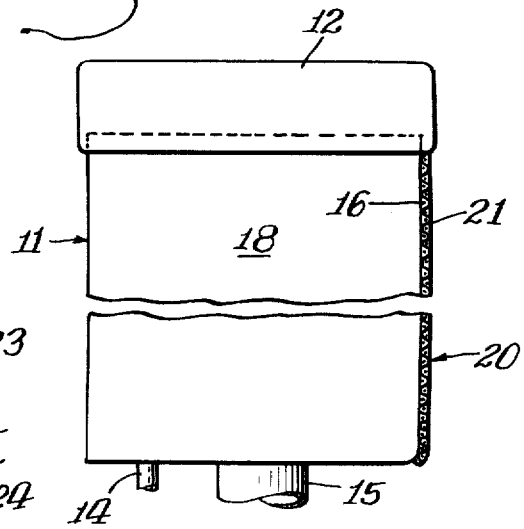
FIG. 3 is a vertical section along line 3—3 of FIG. 2.
Figure 5:
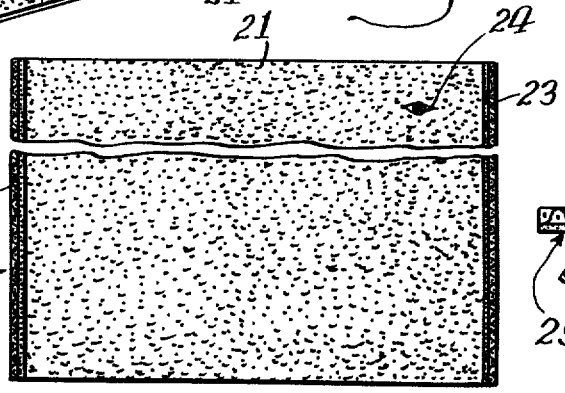
FIG. 5 is a vertical section taken along line 5—5 of FIG. 2.
Figure 6:
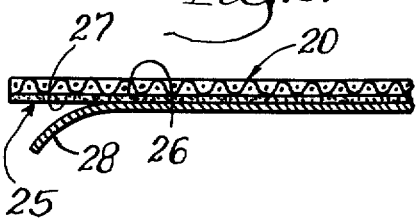
FIG. 6 is a horizontal section along line 6—6 of FIG. 4.

As shown in FIG. 4, the toilet tank cover 20 is in the form of a rectangular jacket of textile material, with the cover having a front portion 21 adapted to cover the front wall 16 of the tank, and two side portions 22 and 23 to cover the side walls 17 and 18 of the tank. In addition, the cover 20 is provided with a slit 24 to receive the handle 13 of the tank.

A sheet 25 of vapor barrier material such as plastic is of the same size and shape as the cover 20. One side 26 of the sheet 25 carries an adhesive coating and is adhesively secured to the back side of the cover 20. The other side 27 of the sheet 25 also carries an adhesive coating but is normally covered by a sheet 28 of peel-off film material.

To apply the tank cover of the present invention to a toilet tank, the peel-off film 28 is removed thereby exposing the adhesive coating on the face 27 of the vapor barrier sheet. This face is applied to the toilet tank, first by placing the slit 24 in registry with the handle 13 so that the latter is on the outside of the cover, and then the front portion of the cover 21 is applied against the front wall 16 of the tank, and the side portions 22 and 23 are folded around the corners of the tank and adhered to the side walls 17 and 18.

The sheet material 25 is, as previously noted, a vapor barrier and because of its double-faced adhesive coating, the cover when once applied to the tank will remain in place without sagging or otherwise becoming unsightly even though the actual weight of the cover varies because of the accumulation of water therein and the subsequent evaporation of water therefrom.

I claim:

1. A cover for a toilet flush tank comprising a generally rectangular jacket of textile material, said jacket having a front portion to cover the front of the tank and side portions to cover the sides of the tank, said front portion having a width sufficient to cover the entire front of the flush tank and a height to extend from the bottom edge of the tank to above the normal level of water in the tank so that at least a major portion of the front wall of the tank is covered thereby, each of said side panels having a height equal to the front portion but having a narrower width to cover substantially the entire side of the tank, a substantially continuous sheet of vapor barrier material of the same size and shape as the jacket, said sheet having one side adhesively secured over substantially its entire area to the entire area of the back of said jacket and the other side of said sheet being provided with an adhesive coating over the entire surface thereof, and a layer of material covering the entire other side of said sheet and peelable therefrom to expose said adhesive coating whereby said material may be peeled from said other side of the sheet and said other side may be applied to the flush tank to cover substantially the entire front and side walls thereof in intimate contact throughout the entire covered area thereof.

* * * * *